US007364639B2

(12) United States Patent
Hu et al.

(10) Patent No.: US 7,364,639 B2
(45) Date of Patent: Apr. 29, 2008

(54) METHOD OF PRODUCING TWISTED, CURLY FIBERS

(75) Inventors: Sheng-Hsin Hu, Appleton, WI (US); Young Chan Ko, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 246 days.

(21) Appl. No.: 11/215,429

(22) Filed: Aug. 29, 2005

(65) Prior Publication Data

US 2005/0279466 A1 Dec. 22, 2005

(51) Int. Cl.
*D21H 15/04* (2006.01)
*D21C 9/00* (2006.01)

(52) U.S. Cl. ..... 162/56; 162/28; 162/57; 162/58; 162/157.6; 162/157.7

(58) Field of Classification Search ..... 162/4, 162/9, 23, 56–58, 68, 78, 90, 28, 91, 100, 162/157.6, 157.7
See application file for complete search history.

(56) References Cited

U.S. PATENT DOCUMENTS

| | | | | |
|---|---|---|---|---|
| 2,516,384 | A * | 7/1950 | Hill et al. | 162/100 |
| 3,987,968 | A | 10/1976 | Moore et al. | |
| 4,431,479 | A * | 2/1984 | Barbe et al. | 162/9 |
| 4,898,642 | A | 2/1990 | Moore et al. | |
| 5,137,537 | A | 8/1992 | Herron et al. | |
| 5,227,021 | A | 7/1993 | Hernesniemi et al. | |
| 5,501,768 | A | 3/1996 | Hermans et al. | |
| 5,709,774 | A * | 1/1998 | Naieni | 162/9 |
| 5,800,417 | A | 9/1998 | Goerg-Wood et al. | |
| 5,834,095 | A | 11/1998 | Dutkiewicz et al. | |
| 6,207,278 | B1 | 3/2001 | Jewell et al. | |
| 6,409,883 | B1 | 6/2002 | Makolin et al. | |
| 6,837,970 | B2 | 1/2005 | Ko et al. | |
| 2003/0111193 | A1 | 6/2003 | Ko et al. | |

FOREIGN PATENT DOCUMENTS

| | | |
|---|---|---|
| EP | 0 252 650 A2 | 1/1988 |
| EP | 0 482 248 A1 | 4/1992 |
| WO | 00/63487 | 10/2000 |
| WO | 00/63492 | 10/2000 |
| WO | 03/052200 | 6/2003 |

* cited by examiner

*Primary Examiner*—Eric Hug
(74) *Attorney, Agent, or Firm*—Armstrong Teasdale, LLP

(57) ABSTRACT

A method of forming twisted, curly fibers from a wet wood pulp without the aid of a wet fluffing process or a chemical cross-linker. The method includes forming the wet wood pulp into fiber bundles and subsequently thermally drying the fiber bundles. The invention also includes curly fibers derived from the method of the invention.

21 Claims, 1 Drawing Sheet

METHOD OF PRODUCING TWISTED, CURLY FIBERS

BACKGROUND OF THE INVENTION

This invention is directed to a method of producing twisted, curly fibers from wet wood pulp.

Wood pulp is commonly used to make paper as well as absorbent articles. When wood pulp fibers are flat, the fibers lack absorbency and softness compared to wood pulp fibers that are twisted or curly.

In the past, curling of fibers has been done primarily by mechanical means, resulting in densification of portions of the fiber wall and mechanical damage to fibers. Also in the past, many cross-linking efforts have tended to decrease the swellability of fibers.

Never-been-dried wood pulp has many fine pores within the cell walls in a multi-lamellar fashion. The pores are commonly referred to as intra-fiber capillaries, in contrast to inter-fiber capillaries that are formed between individual fibers. The intra-fiber capillaries of a never-been-dried pulp are highly vulnerable to outside forces such as the surface tension of water, electrolytes, mechanical and thermal treatments to name a few. In particular, intra-fiber capillaries are easily collapsed during conventional thermal drying, such as during drum drying. When the intra-fiber capillaries of a never-been-dried pulp collapse during drying, the width, or diameter, of individual fibers shrinks. As a result, the morphology of once-dried wood pulp tends to be flat and ribbon-like, and the intra-fiber capillaries practically disappear.

Once-dried fibers can be re-wet to open up and increase the swellability. If a fiber does not shrink uniformly during drying, its fiber morphology will be quite different from the conventional ribbon-like fiber morphology. Such fibers that shrink non-uniformly are likely to be coiled or twisted. The degree of coils or twists per individual fiber depends on the number of intra-fiber capillaries within the wood pulp and the degree of non-uniform shrinkage of fiber diameters along their fiber axes, i.e., perpendicular to the fiber diameter direction.

In order to obtain a short drying time during a thermal drying process such as flash drying, wet pulp is conventionally defiberized into low density, individual fibers prior to drying so that the largest possible pulp surface is exposed to the hot drying air. Such defiberization is known as wet fluffing. It is believed by many that the fluffing operation is the key to a successful flash drying system. Unfortunately, however, a thorough wet fluffing is difficult to achieve, generally requiring multiple steps. For example, one particular fluffing method treats moist cellulosic pulp fibers to a combination of mechanical impact, mechanical agitation, air agitation, and a limited amount of air drying to create fluff fibers.

Curly, twisted cellulose fibers can be produced by permanently interlocking the intra-fiber capillaries with a chemical cross-linker prior to flash drying. The use of a chemical cross-linker is unfavorable for a number of reasons. In particular, the use of a chemical cross-linker involves safety concerns since chemical cross-linkers are generally hazardous and harmful. Therefore, the use of a chemical cross-linker requires a thorough washing of unreacted chemical cross-linker for safety. Also, the use of a chemical cross-linker is likely to cause interlocking between fibers that would be difficult to be defiberized into individual fibers for a product application. Potential damage to the fibers may occur during the defiberization stage due to interlocking of the fibers. It can be difficult to form an absorbent product due to such interlocking of fibers. Furthermore, the use of a chemical cross-linker is not very economical due to the complexity of handling such a chemical cross-linker. With respect to the present invention, such permanently interlocking intra-fiber capillary structures tend to make the fibers stiffened and destroy all the useful capillaries as fluid channels.

There is a need or desire for a method of modifying wood pulp fibers to form twisted, curly fibers without the aid of a wet fluffing process or a chemical cross-linker.

SUMMARY OF THE INVENTION

In response to the discussed difficulties and problems encountered in the prior art, a new method of producing twisted, curly fibers has been discovered.

The present invention is directed to a method of producing twisted, curly fibers from a wet wood pulp. Rather than wet fluffing the pulp, the method instead includes forming wet fiber bundles, or aggregates, prior to thermal drying, and defiberizing the fiber bundles after the bundles have been thermally dried.

In addition to wet wood pulp, the method may be performed using a slurry of other hydrophilic material such as microcrystalline cellulose, microfibrillated cellulose, superabsorbent material, wood pulp fiber, and combinations of any of these. The wet wood pulp, or slurry, suitably has a consistency between about 1% and about 15%. After forming the slurry, the fibers can be de-watered or wet-pressed to a consistency between about 15% and about 60%.

A mechanical device, such as a disperser, may be used to extrude or otherwise form the wet wood pulp into fiber bundles. The size of the fiber bundles is suitably between about 200 and about 5000 micrometers mean area-weighted convoluted width.

The fiber bundles may be dried by flash drying or other suitable thermal drying method. In any case, the thermal drying is suitably carried out at a temperature between about 120 and about 400 degrees Celsius, for between about 0.1 and about 60 seconds. Multiple stages could be used to get a desirable consistency, between about 90% and about 95%, if necessary.

After the fiber bundles have been thermally dried, the bundles may be defiberized into individual fibers. The fibers can be used to form a cellulose, fibrous material suitable for making paper and absorbent products through wetlaid or airformed processes.

With the foregoing in mind, it is a feature and advantage of the invention to provide a method of modifying wood pulp fibers to form twisted, curly fibers without the aid of a wet fluffing process or a chemical cross-linker.

Definitions

Figure 1:
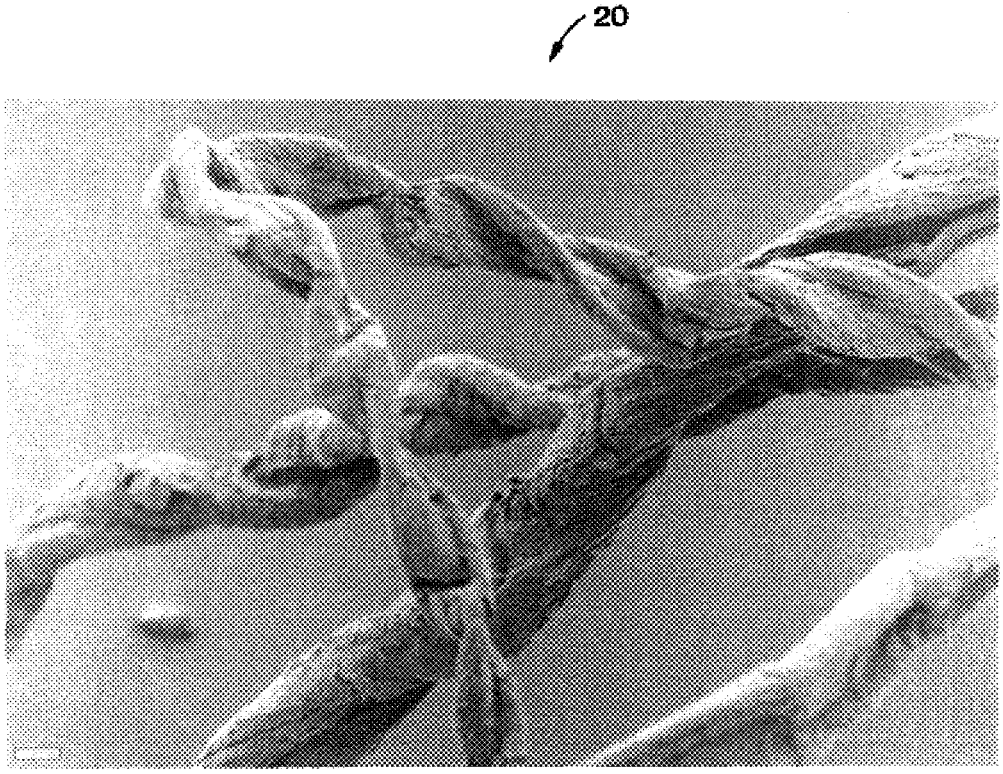
FIG. 1 is a perspective view of a fiber twist.

Within the context of this specification, each term or phrase below will include the following meaning or meanings.

"Cellulosic" or "cellulose" includes any material having cellulose as a major constituent, and specifically, comprising at least 50 percent by weight cellulose or a cellulose derivative. Thus, the term includes cotton, typical wood pulps, cellulose acetate, rayon, thermomechanical wood pulp, chemical wood pulp, debonded chemical wood pulp, milkweed floss, microcrystalline cellulose, microfibrillated cellulose, and the like.

"Curl" or "curl value" of a fiber is the measure of fractional shortening of a fiber due to kinks, twists, and/or bends in the fiber. For the purposes of this invention, a fiber's curl value is measured in terms of a two-dimensional plane, determined by viewing the fiber in a two-dimensional plane. To determine the curl value of a fiber, the projected length of a fiber as the longest dimension of a two-dimensional rectangle encompassing the fiber, l, and the actual length of the fiber, L, are both measured. An image analysis method may be used to measure L and l. A suitable image analysis method is described in U.S. Pat. No. 4,898,642, incorporated herein in its entirety by reference. The curl value of a fiber can then be calculated from the following equation:

$$\text{Curl value}=(L/l)-1$$

"Defiberize" or "defiberization" refers to a process of separating a group or bundle of fibers into at least 70% individual fibers.

"Dry defiberizing" refers to a method of defiberizing in which fiber bundles are mechanically separated, while in a dry state, into essentially individual fibers using any equipment and processes known to those skilled in the art.

"Drying aid" refers to any material, such as a surfactant, that speeds up the removal of water from intra-fiber capillaries of a fiber.

"Fiber" or "fibrous" refers to a particulate material wherein the length to diameter ratio of such particulate material is greater than about 5. Conversely, a "nonfiber" or "nonfibrous" material is meant to refer to a particulate material wherein the length to diameter ratio of such particulate material is about 5 or less.

"Fiber bundle" refers to a generally particulate material consisting essentially of entangled fibers. As such, the fiber bundle will also generally comprise capillaries or voids within the structure of the fiber bundle between the entangled fibers forming the fiber bundle. A fiber bundle may also be referred to by other terms known in the art such as fiber nits or fiber flakes. As will be appreciated by those skilled in the art, a fiber bundle will generally have an irregular, nonspherical shape. Furthermore, as will be appreciated by those skilled in the art, the fiber bundles comprising a fiber bundle sample will generally exhibit a range of sizes, since the production of fiber bundles will generally not result in uniform fiber bundles.

"Fiber twist" refers to the fiber morphology of a coiled or twisted fiber, as shown in FIG. 1.

"Flash dryer" and "flash drying" refer to a thermal drying method in which wet material is exposed to a hot air (or gas) stream at a very short residence time as a means of drying the wet material.

"Hydrophilic" describes fibers or the surfaces of fibers which are wetted by the aqueous liquids in contact with the fibers. The degree of wetting of the materials can, in turn, be described in terms of the contact angles and the surface tensions of the liquids and materials involved. Equipment and techniques suitable for measuring the wettability of particular fiber materials or blends of fiber materials can be provided by a Cahn SFA-222 Surface Force Analyzer System, or a substantially equivalent system. When measured with this system, fibers having contact angles less than 90° are designated "wettable" or hydrophilic, while fibers having contact angles greater than 90° are designated "nonwettable" or hydrophobic.

"Individualized" refers to fibers that have been defiberized or otherwise separated from a group or bundle such that at least 70% of the fibers are not part of a group or a bundle but instead exist as separate fibers.

"Never-been-dried" is a term used to describe fibers that have never been exposed to a drying process, such as thermal drying or forced air drying.

"Repulping" refers to a method of defiberizing in which dried fiber bundles are soaked in water and mechanical agitation is applied to the soaked bundles.

"Thermal drying" refers to a process of drying fibers or other material in which heat is used to accelerate the drying.

"Twist count" refers to the number of twist nodes present along a longitudinal axis of a fiber over a certain length of the fiber. Twist count is used to measure the degree to which a fiber is rotated about its longitudinal axis. The term "twist node" refers to a substantially axial rotation of 180 degrees about the longitudinal axis of the fiber, wherein a portion of the fiber (i.e., the "node") appears dark relative to the rest of the fiber when viewed under a microscope with transmitted light because the transmitted light passes through an additional fiber wall due to the above-mentioned rotation.

"Water Retention Value (WRV)" refers to the volume of the intra-capillaries within the fibers. It is conventionally determined according to the following method: A sample of 0.700±0.100 oven-dry gram of the sample is put into a specimen container, with a lid. The total volume in the container is brought up to 100 ml with purified (distilled or deionized) water. Gentle dispersion techniques are applied to the specimen until the nit or clumps of fibers are not present. The dispersed fibers are collected by removing excess water with a filter system under vacuum. The fibers are then placed into a centrifuge tube with a screen and the fibers are centrifuged at a relative centrifuge force of 900 gravities for 30 minutes. When the centrifuge is completed, the tube cap is removed with a dissecting needle to retrieve the fibers from the filter paper in the tube. After taring a weighing dish, the fibers are weighed and the wet weight of the fibers is recorded. The weighing dish is then placed with the fibers in a 105±2 degrees Celsius oven for a minimum of 12 hours. The dried fibers are then weighed. The water retention value (WRV) is calculated using the following equation: $WRV=(W-D)/D$, wherein W is the wet weight of the fibers, and D is the dry weight of the fibers. The WRV is in units of grams of water per gram of dry fiber.

These terms may be defined with additional language in the remaining portions of the specification.

DETAILED DESCRIPTION OF THE PRESENTLY PREFERRED EMBODIMENTS

The present invention is generally directed to a method of modifying wood pulp fiber morphology to produce three-dimensional twisted, curly fibers from a wet wood pulp. Instead of using a chemical cross-linker, the fibers can be modified using bundling and thermal drying technologies, such as flash drying. Compared to other methods, particularly methods that include wet fluffing, the method of the invention produces fibers having a higher degree of curl.

One version of a method of the present invention includes modifying a two-dimensional, flat, ribbon-like fiber morphology of a never-been-dried wood pulp into a three-dimensional twisted, curly fiber morphology without the use of a chemical cross-linker or wet fluffing. Instead, a method of the present invention is carried out by first bundling the fibers into bundles followed by thermal drying.

The method of the invention can be used to modify virtually any type of wood pulp, including but not limited to chemical pulps such as sulfite and sulfate (sometimes called Kraft) pulps, as well as mechanical pulps such as ground wood, thermomechanical pulp and chemithermomechanical pulp. Pulps derived from both deciduous and coniferous trees can be used. Although the invention is directed to the modification of wood pulp fiber morphology, the invention may also be used to modify the morphology of other hydrophilic materials in a slurry. For example, the invention can be used on such hydrophilic materials as microcrystalline cellulose, microfibrillated cellulose, superabsorbent material, or a combination of any of these materials, or any of these materials in combination with wood pulp fibers.

The principle behind the present invention is that a never-been-dried fiber that does not shrink uniformly during drying will have a fiber morphology quite different from conventional ribbon-like fiber morphology. Non-uniformly dried fibers are likely to be coiled or twisted, and the degree of coils or twists per individual fiber depends on the amount of the intra-fiber capillaries of wood pulp and the degree of non-uniform shrinkage of fiber diameters along their fiber axes, i.e., perpendicular to the fiber diameter direction. The degree of non-uniformity of the fiber shrinkage inducing the fiber coils is expected to increase when a never-been-dried pulp is formed into a bundle, rather than fluffed, and the bundle is thermally dried under an extremely high drying temperature and a very short drying time.

Wet wood pulp may be formed into one or more bundles, or aggregates, using a mechanical device, such as a disperser. The wet wood pulp is first formed into a slurry having a consistency between about 1% and about 15%, or between about 3% and about 10% by weight. A drying aid, or de-bonding agent, can be added to the slurry prior to forming the bundles. As a drying aid, any material that speeds up the removal of water from the intra-fiber capillaries can be used. Suitable drying aids include surfactants, such as an anionic surfactant, a cationic surfactant, or a combination of an anionic surfactant, a cationic surfactant and a non-ionic surfactant. An example of a commercially available drying aid is a cationic surfactant available from Goldschmidt Chemical of Dublin, Ohio, under the trade name ADOGEN 442. Another example of a commercially available drying aid is an anionic surfactant available from Cytec Industry of Morristown, N.J., under the trade name AEROSOL OT-75.

The wet pulp may be dewatered using any suitable mechanism, such as a filter press or centrifugation, to achieve a suitable level of consistency, such as between about 15% and about 60%, or between about 25% and about 40%. The wet wood pulp slurry may then be processed through a disperser, or other suitable bundling device, and extruded from the disperser in the form of bundles. The size of the bundles is suitably between about 200 and about 5000, or between about 1000 and about 2000 micrometers mean area-weighted convoluted width.

One example of a high-energy disperser suitable for forming the fiber bundles of the invention is available from Ing. S. Maule & C. S.p.A., Torino, Italy, under the designation GRII, and another example of a suitable disperser is available from Clextral Company, Firminy Cedex, France, under the designation Bivis high-energy disperser. The Bivis high-energy disperser is a twin screw disperser. A slurry of wet wood pulp or other hydrophilic fibers is introduced through an inlet where the mixture encounters a short feed screw. The feed screw transfers the fiber mixture to a first working zone. The working zone consists of a pair of intermeshing screws which are enclosed in a cylindrical housing. The screws co-rotate to transport the fiber mixture axially through the disperser. High energy dispersing is achieved by using reverse-flighted screws which have small slots machined in the flights. Reverse-flighted screws are positioned periodically along the length of both screws and serve to reverse the flow of the fiber mixture through the machine, thereby introducing back pressure. Pressure builds up in this zone and forces the fiber mixture to flow through the slots in the reverse flights into the next forward flighted screw section which is at a lower pressure. This compression/expansion action imparts a high energy to the fiber mixture during dispersion. Steam can be injected into the fiber mixture to carry out high temperature dispersing. Typical conditions for using such a disperser include an energy level of about 15 to about 300 kilowatt hours per ton of fiber mixture.

Once the wet wood pulp has been formed into one or more bundles, the bundles are then thermally heated. More particularly, the thermal drying is carried out at a temperature between 120 and 400 degrees Celsius. The temperature depends largely on the consistency, with higher temperatures being more appropriate for lower consistency pulps. The thermal drying is carried out for between about 0.1 and about 60 seconds.

One particularly suitable thermal drying technology is flash drying. Flash drying is a well-known thermal drying method used to dry various materials, such as wood pulps, gypsum, and native starch. In flash drying, a wet material is exposed to a very hot drying air (or gas) environment without any constraints at a very short time, for example, a few seconds. These drying conditions of a flash dryer for wood pulp fibers can cause fibers to be in a non-equilibrium state during drying so as to make the fibers shrink non-uniformly. This results in fibers having coiled structures. In addition, such a short drying time provides very little opportunity for the pores within the fibers to collapse, thereby resulting in enhanced absorptive properties for the fibers.

The thermally dried fiber bundles can be defiberized into individual fibers. Defiberizing may be accomplished by dry defiberizing the fiber bundles, or, alternatively, by repulping the fiber bundles in water. As yet another alternative, the fiber bundles may be separated into individual fibers by repulping, and then the wet individual fibers can be dried with a conventional pulp drying method, and subsequently the dry pulp sheet can be separated into individual fibers by dry defiberizing. Suitable equipment for defiberizing include a hammermill, a Bauer mill, a Fritz mill, a pair of counter-rotating toothed roll, a disc refiner, a carding device, or the like.

Once the fibers have been modified according to the method of the invention, at least 70%, or at least 80%, or at least 85% of the treated fibers include fiber twists. An illustration of a twisted fiber 20 is shown in FIG. 1. As can be seen in FIG. 1, intra-fiber capillaries within the fiber twists remain intact. More particularly, fibers modified in accordance with the invention can have an average dry fiber twist count of at least about 1.5 twist nodes per millimeter, or at least about 2.0 twist nodes per millimeter, or at least about 2.5 twist nodes per millimeter, and an average wet fiber twist count of at least about 1.5 twist nodes per millimeter, or at least about 2.0 twist nodes per millimeter. Twist count can be determined using the test method described below.

Water retention value (WRV) is a measure that can be used to characterize some fibers useful for purposes of this invention. More particularly, the fibers resulting from the method of the present invention suitably have a WRV of at least 0.7 grams of water per gram of dry fiber, or between 0.8 grams/gram and 1.5 grams/gram, or between 0.9 grams/gram and 1.3 grams/gram.

Curl value, or curl index, is a measure that can be used to determine the level of curliness of the fibers. The fibers of the invention suitably have an average curl index of at least 0.15, or between about 0.15 and about 0.50, or between about 0.2 and about 0.3.

Because of their remarkable absorbency and because they are very bulky, soft, and compressible, the wood pulp or other hydrophilic fibers modified according to the present invention can be formed into cellulosic, fibrous material that is particularly suitable for use in paper, tissue, towels, absorbent materials and absorbent articles, including diapers, training pants, swim wear, feminine hygiene products, incontinence products, other personal care or health care garments, including medical garments, or the like. It should be understood that the present invention is applicable to fibers used in other structures, composites, or products incorporating absorbent fibers that can be modified according to the method of the present invention.

the belt press and then transferred to the Maule disperser (GR II, Ing. S. Maule & C. S.p.A., Torino, Italy). by a heating screw, to raise the inlet temperature to approximately 80 degrees Celsius. The Maule outlet temperature was approximately 100 degrees Celsius. The slurry was processed through the Maule disperser with a targeted energy input of about 100 kW-h/ton to form fiber bundles that were extruded from the disperser.

The size and shape measurements of the fiber bundles are shown in Table 1. These measurements were obtained using the Test Method for Characterizing Fiber Bundles described in detail below.

It should be noted that shape measurements (circularity, joins & forks) were performed on the nits prior to the removal of protruding fibers via image processing. In contrast, size measurements (convoluted length and width) were made on the nits after removal of the protruding fibers via image processing. Both before and after image processing perimeter measurements were used to determine the hairiness factor. Data were acquired from approximately 130 randomly sampled fiber nits.

TABLE 1

Size and Shape Measurements of LL-19 Fiber Bundles

| Measurement Parameter (units) & Description | Mean | Std. Dev. | Max. | Min. |
|---|---|---|---|---|
| Circularity—Shape<br>$\pi \times (\text{Length})^2/4 \times \text{Area}$ | 3.81 | 2.04 | 11.68 | 1.45 |
| Area-Wt. Convoluted Width (um)<br>$0.9 \times (4 \times \text{Area/Perimeter 2}) \times (4 \times \pi \times \text{Area}/(\text{Perimeter 2})^2)^{0.25}$ | 1727.00 | 704.94 | 3789.00 | 480.71 |
| Count-Wt. Convoluted Width (um)<br>$0.9 \times (4 \times \text{Area/Perimeter 2}) \times (4 \times \pi \times \text{Area}/(\text{Perimeter 2})^2)^{0.25}$ | 1326.56 | 581.17 | 3789.00 | 480.71 |
| Convoluted Length (um)<br>$(\text{Perimeter 2}/2) - (2 \times \text{Area/Perimeter 2})$ | 6006.73 | 4454.34 | 24197.84 | 1211.48 |
| Forks & Joins—Shape<br>(Forks + Joins)/2 | 4.84 | 3.15 | 19.00 | 0.50 |
| Hairiness Factor—Shape<br>(Perimeter 1 − Perimeter 2)/Perimeter 2 | 0.42 | 0.51 | 3.22 | 0.01 |

Perimeter 1 = Perimeter after initial detection (with "hair")
Perimeter 2 = Perimeter after image processing (without "hair")

EXAMPLES

Sample 1—Market pulp LL-19 fibers available from Kimberly-Clark Corp.'s Terrace Bay Mill in Ontario, Canada. This pulp is served as control.

Sample 2—Flash Dried dispersed LL-19

This Example illustrates the preparation of the flashed dried dispersed fibers of Sample 2. Approximately 1000 kg of LL-19 kraft pulp, available from Kimberly-Clark Corp.'s Terrace Bay Mill in Ontario, Canada, were fed to a high consistency pulper (Model ST-C-W, Voith-Sulzer PaperTech, formerly Sulzer Escher-Wyss Gmbh, Ravensburg, West Germany) with the addition of dilution water to reach a consistency of between about 12% and 14%. The pulp was treated in the pulper for approximately 30 minutes. At the end of pulping, the pulp was further diluted to a consistency of approximately 4% and pumped via a pulper dump pump over to a dump chest having an agitator running. The pulp was then pumped at a consistency of approximately 4% to a the headbox of a belt press (Continuous Belt Press, Model CPF 0.5 meter, P3, Andritz-Ruthner, Inc., Arlington, Tex., USA). The pulp was discharged from the belt press at a consistency of about 30% to a break-up screw at the end of The fiber bundles were then fed into a pilot scale Barr-Rosin Ring Flash Dryer (made by Barr-Rosin Inc. of Bolsbriand, Quebec, Canada), with (9-inch by 12-inch) duct (located at Innovation Place, Saskatoon, Saskatchewan, Canada) and 400 kilogram per hour designed water evaporative capacity. The inlet air temperatures were at about 235 degrees Celsius and the outlet air temperatures were at about 150 degrees Celsius. The flash dried LL-19 fibers at 95% consistency were found twisted and curled.

Sample 3—Chemical Cross-Linked and Flash Dried Fiber

In this example, chemical cross-linked and flash dried fibers were obtained from a PAMPERS diaper, manufactured by Procter & Gamble of Cincinnati, Ohio, U.S.A. The WRV and number of twists were determined and are provided in Table 2, below.

Sample 4—Flash Dried LL-19

Market pulp LL-19 fibers available from Kimberly-Clark Corp.'s Terrace Bay Mill in Ontario, Canada. This pulp was re-pulped into pulp slurry in the laboratory. The pulp slurry was dewatered to about 35% consistency using a centrifuge. The 35% consistency pulp pad was shredded into small pieces. The small pieces of wet pulp pads were further disintegrated with air from air nozzles. The disintegrated fibers were flashed dried to about 93% consistency with the same equipment under the same conditions. The flashed dried LL-19 fibers were tested for WRV, number of twists per mm, and fiber curl index, as shown in Table 2.

TABLE 2

Water Retention Value, Fiber Twist Data, and Fiber curl Index

| Sample | WRV (gram water/ gram dry fiber) | Number of Twists per Millimeter | Fiber Curl Index |
|---|---|---|---|
| 1 | 1.14 | — | 0.11 |
| 2 | 1.24 | 2.59 | 0.26 |
| 3 | 0.45 | 3.21 | 0.28 |
| 4 | 1.16 | 2.16 | 0.14 |

Sample 5—Flash Dried dispersed LL-19

The LL-19 fiber bundles prepared as described in Sample 2 were fed into a pilot scale Cage Mill Flash Drying System (available from Alstom Power Inc. at Lisle, Ill.). The operations were conducted as follows:

1st stage: Inlet temperature 1035 degrees Fahrenheit
Outlet temperature 375 degrees Fahrenheit
Outlet consistency 44.5%
Feed Rate: 270 lb/Hr 2nd stage: Inlet temperature 850 degrees Fahrenheit
Outlet temperature 350 degrees Fahrenheit
Outlet consistency—86.3%
Feed Rate: 116 lb/Hr 3rd stage: Inlet temperature 760 degrees Fahrenheit
Outlet temperature 350 degrees Fahrenheit
Outlet consistency 97%
Feed Rate: not measured The flash dispersed dried LL-19 had 2.54 fiber twists per millimeter.

Test Method for Characterizing Fiber Bundles

Fiber bundles (or nits) are dispersed onto a 5-inch×5-inch glass plate. A pointed probe is then used to carefully tease apart any nits that are loosely clumped together. The plate is placed onto an auto-stage, available from DCI of Franklin, Miss., resting on a Kreonite® Macroviewer (Wichita, Kans.). A Quantimet 600 IA System (available from Leica, Inc of Cambridge, UK) can be used to perform the analysis on the fiber bundles or nits. The Quantimet 600 system is equipped with QWIN version 1.06A system software. The optical configuration includes the following:

SONY® 3CCD video camera model #DXC-930P (SONY® Electronics, Kansas City, Mo.)

35-mm adjustable Nikon lens with an f-stop setting=4 (Nikon Corp., Tokyo, Japan)

Transmitted lighting via a ChromaPro 45 (Zeiss Inc.) and a black mask with a 5-inch×5-inch opening located at the light source. The auto-stage acts as a spacer.

The macroviewer pole position is set at 69.6 cm.

In order to acquire data using the customized parameters, a program entitled 'FIBNIT1' was developed and written by implementing the Quantimet User Interactive Programming System (QUIPS) language residing on the Quantimet 600 system. The program routine is shown in the Appended Code Example below. The program was written to acquire data for each measurement parameter described in Table 1 as well as to control the system during the analysis.

Twist Count Image Analysis Method

Dry fibers are placed on a slide and then covered with a cover slip. An image analyzer (Quankimet 970) comprising a computer-controlled microscope (Olympus BH2), and a video camera are used to determine twist count per millimeter fiber length.

The fiber length of a fiber within a screen field is measured by the image analyzer. The twist nodes of the same fiber are identified and counted by an operator using the microscope at 100×. This procedure is continued by selecting a fiber randomly, one fiber at a time, measuring fiber length and counting twist nodes of each of the fibers until 100 fibers randomly selected with at least one twist node are analyzed. The number of fibers without any twist nodes is also recorded. The number of twist nodes per millimeter is calculated from the data by dividing the total number of twist nodes (N) counted by the total fiber length (L) and/or can be expressed by the following equation:

$$\text{Number of twist nodes per millimeter}=N/L$$

The yield of the twist fibers is determined as follows:

$$\%\ \text{Yield}=100*(1-(Tn/(Tn+100)))$$

where Tn is the number of fibers without any twist nodes.

Test Method for Determining Wet Curl Value

The Wet Curl value for fibers was determined by using an instrument which rapidly, accurately, and automatically determines the quality of fibers, the instrument being available from OpTest Equipment Inc., Hawkesbury, Ontario, Canada, under the designation Fiber Quality Analyzer, OpTest Product Code DA93.

A sample of dried cellulosic fibers was obtained. The cellulosic fiber sample was poured into a 600 milliliter plastic sample beaker to be used in the Fiber Quality Analyzer. The fiber sample in the beaker was diluted with tap water until the fiber concentration in the beaker was about 10 to about 25 fibers per second for evaluation by the Fiber Quality Analyzer. An empty plastic sample beaker was filled with tap water and placed in the Fiber Quality Analyzer test chamber. The <System Check> button of the Fiber Quality Analyzer was then pushed. If the plastic sample beaker filled with tap water was properly placed in the test chamber, the <OK> button of the Fiber Quality Analyzer was then pushed. The Fiber Quality Analyzer then performs a self-test. If a warning was not displayed on the screen after the self-test, the machine was ready to test the fiber sample.

The plastic sample beaker filled with tap water was removed from the test chamber and replaced with the fiber sample beaker. The <Measure> button of the Fiber Quality Analyzer was then pushed. The <New Measurement> button of the Fiber Quality Analyzer was then pushed. An identification of the fiber sample was then typed into the Fiber Quality Analyzer. The <OK> button of the Fiber Quality Analyzer was then pushed. The <Options> button of the Fiber Quality Analyzer was then pushed. The fiber count was set at 4,000. The parameters of scaling of a graph to be printed out may be set automatically or to desired values. The <Previous> button of the Fiber Quality Analyzer was then pushed. The <Start> button of the Fiber Quality Analyzer was then pushed. If the fiber sample beaker was properly placed in the test chamber, the <OK> button of the Fiber Quality Analyzer was then pushed. The Fiber Quality Analyzer then began testing and displayed the fibers passing through the flow cell. The Fiber Quality Analyzer also displayed the fiber frequency passing through the flow cell, which should be about 10 to about 25 fibers per second. If the fiber frequency is outside of this range, the <Stop> button of the Fiber Quality Analyzer should be pushed and the fiber sample should be diluted or have more fibers added to bring the fiber frequency within the desired range. If the fiber frequency is sufficient, the Fiber Quality Analyzer tests the fiber sample until it has reached a count of 4000 fibers at which time the Fiber Quality Analyzer automatically stops. The <Results> button of the Fiber Quality Analyzer was then pushed. The Fiber Quality Analyzer calculates the Wet Curl value of the fiber sample, which prints out by pushing the <Done> button of the Fiber Quality Analyzer.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

```
NAME: FIBNIT1
    PURPOSE: Characterizes Fiber Nits - Size and Shape
    CONDITIONS: Sony 3CCD vid. camera; 35-mm adj. Nikon lens (f/4); trans. lighting w/
mask; 5"×5" glass plate; random drop deposition; macro. pole=69.6
    AUTHOR: D. G. BIGGS
    DATE: December 17, 2002
    OPEN EXCEL DATA FILES
    Open File ( C:\EXCEL\PERIM1.XLS, channel #1 )
    Open File ( C:\EXCEL\PERIM2.XLS, channel #2 )
    Open File ( C:\EXCEL\PERIM3.XLS, channel #3 )
    SET UP IMAGING
    Enter Results Header
    File Results Header ( channel #1 )
    File Results Header ( channel #2 )
    File Results Header ( channel #3 )
    Image frame ( x 0, y 0, Width 736, Height 574 )
    Measure frame ( x 32, y 61, Width 676, Height 512 )
    Calibrate ( CALVALUE CALUNITS$ per pixel )
    Image Setup [PAUSE] ( Camera 5, White 48.74, Black 94.11, Lamp 23.20 )
    Stage ( Define Origin )
    Stage ( Scan Pattern, 3 × 3 fields, size 56899.882813 × 43599.765625 )
    IMAGE ACQUIRE AND DETECTION
    For ( FIELD = 1 to FIELDS, step 1 )
        Clear Accepts
        Image Setup [PAUSE] ( Camera 5, White 47.89, Black 95.80, Lamp 23.25 )
        Acquire ( into Image0 )
        Detect ( blacker than 160, from Image0 into Binary0 delineated )
        Binary Amend ( Dilate from Binary0 to Binary1, cycles 1, operator Disc, edge erode on)
        Binary Amend ( Skeleton from Binary1 to Binary2, cycles 1, operator Disc, edge erode on )
        IMAGE PROCESSING AND CLEAN UP
        PauseText ( "Reject stray items from the field-of-view," )
        Binary Edit [PAUSE] ( Reject from Binary2 to Binary3, nib Fill, width 2 )
        Binary Amend ( White Exh. Skeleton from Binary3 to Binary4, cycles 0, operator Disc,
edge erode on, alg. 'L' Type )
        Binary Amend ( Open from Binary3 to Binary5, cycles 2, operator Disc, edge erode on )
        Binary Amend ( Close from Binary5 to Binary6, cycles 1, operator Disc, edge erode on)
        Binary Identify ( FillHoles from Binary6 to Binary7 )
        MEASUREMENT #1 - W/ EXTENDING FIBERS
        File Line ( channel #1 )
        Measure feature ( plane Binary3, 8 ferets, minimum area: 25, grey image: Image0 )
            Selected parameters: Area, X FCP, Y FCP, Length, Perimeter, ConvxPerim,
            UserDef1, UserDef2, UserDef3
        Feature Expression ( UserDef1 ( all features ), title CPW =
0.9*(4*PAREA(FTR)/PPERIMETER(FTR))*(4*3.1416*PAREA(FTR)/(PPERIMETER(FTR))**2)**0.25 )
        Feature Expression ( UserDef2 ( all features ), title CPL = (PPERIMETER(FTR)/2)–
(2*PAREA(FTR)/PPERIMETER(FTR)) )
        Feature Expression ( UserDef3 ( all features ), title Circularity =
(3.1416*(PLENGTH(FTR))**2)/(4*PAREA(FTR)) )
        Feature Accept :
            Area from 499977.5313 to 100000008.
        Display Feature Results ( x –4, y 634, w 564, h 367 )
        File Feature Results ( channel #1 )
        Feature Histogram #1 ( Y Param Number, X Param UserDef3, from 1. to 16., linear, 15 bins )
        Display Feature Histogram Results ( #1, horizontal, differential, bins + graph (Y axis
linear), statistics )
            Data Window ( 740, 488, 536, 528 )
        MEASUREMENT #2 - W/O EXTENDING FIBERS
        File Line ( channel #2 )
        Binary Edit [PAUSE] ( Reject from Binary7 to Binary8, nib Fill, width 2 )
        Measure feature ( plane Binary8, 8 ferets, minimum area: 25, grey image: Image0 )
            Selected parameters: Area, X FCP, Y FCP, Length, Perimeter, ConvxPerim,
            UserDef1, UserDef2, UserDef3
        Feature Expression ( UserDef1 ( all features ), title CPW =
```

-continued

```
0.9*(4*PAREA(FTR)/PPERIMETER(FTR))*(4*3.1416*PAREA(FTR)/(PPERIMETER(FTR))**2)**0.25 )
        Feature Expression ( UserDef2 ( all features ), title CPL = (PPERIMETER(FTR)/2)-
(2*PAREA(FTR)/PPERIMETER(FTR)) )
        Feature Expression ( UserDef3 ( all features ), title Circularity =
(3.1416*(PLENGTH(FTR))**2)/(4*PAREA(FTR)) )
        Display Feature Results ( x 613, y 635, w 564, h 367 )
        Feature Histogram #2 ( Y Param Number, X Param UserDef1, from 40. to 40000.,
logarithmic, 15 bins )
        Display Feature Histogram Results ( #2, horizontal, differential, bins + graph (Y axis
linear), statistics )
            Data Window ( 742, 40, 536, 474 )
        Feature Histogram #3 ( Y Param Number, X Param UserDef2, from 30. to 30000.,
logarithmic, 15 bins )
        Feature Histogram #4 ( Y Param Area, X Param UserDef1, from 30. to 30000., logarithmic, 15 bins )
        File Feature Results ( channel #2 )
        MEASURE TOPOLOGICAL FEATURES OF THE SKELETON
        File Line ( channel #3 )
        Measure feature ( plane Binary4, 8 ferets, minimum area: 25, grey image: Image0 )
            Selected parameters: X FCP, Y FCP, Forks, Joins, UserDef4
        Feature Expression ( UserDef4 ( all features ), title TOPO1 = (PFORKS(FTR)+PJOINS(FTR))/2 )
        Feature Histogram #5 ( Y Param Number, X Param UserDef4, from 0. to 20., linear, 15 bins )
        File Feature Results ( channel #3 )
        Stage ( Step, Wait until stopped + 10 × 55 msecs )
    Next ( FIELD )
    CLOSE DATA FILES
    Close File ( channel #1 )
    Close File ( channel #2 )
    Set Print Position ( 8 mm, 8 mm )
    Print Results Header
    Print ( "Count vs. Shape (Circularity)", no tab follows )
    Print Line
    Print Feature Histogram Results ( #1, horizontal, differential, bins + graph (Y axis linear), statistics )
    Print ( "Area-wt. CPW (um)", no tab follows )
    Print Line
    Print Feature Histogram Results ( #4, horizontal, cumulative +, bins + graph (Y axis linear), statistics )
    Print Page
    Print ( "Count vs. CPW", no tab follows )
    Print Line
    Print Feature Histogram Results ( #2, horizontal, differential, bins + graph (Y axis linear), statistics )
    Print ( "Count vs. Convoluted Pore Length (CPL)", no tab follows )
    Print Line
    Print Feature Histogram Results ( #3, horizontal, differential, bins + graph (Y axis linear), statistics )
    Print Page
    Print ( "Count vs. (Forks + Joins)/2", no tab follows )
    Print Line
    Print Feature Histogram Results ( #5, horizontal, differential, bins + graph (Y axis linear), statistics )
    Set Image Position ( left 105 mm, top 99 mm, right 163 mm, bottom 145 mm, Aspect =
Image Window,
                Caption:Bottom Centre,"Example Image" )
    Grey Util ( Print Image0 )
End
```

What is claimed is:

1. A method of producing twisted, curly fibers, comprising:

providing a slurry of a hydrophilic material;

forming the slurry of the hydrophilic material into a plurality of fiber bundles;

thermally drying the fiber bundles at a temperature between about 120 and about 400 degrees Celsius for a duration of between about 0.1 and about 60 seconds; and defiberizing the dried fiber bundles.

2. The method of claim 1, wherein the hydrophilic material is selected from the group consisting of microcrystalline cellulose, microfibrillated cellulose, wood pulp fiber, and combinations thereof.

3. The method of claim 1, further comprising dewatering the slurry to a consistency between about 10% and about 60%.

4. The method of claim 1, further comprising dewatering the slurry to a consistency between about 25% and about 40%.

5. The method of claim 1, comprising extruding the slurry of the hydrophilic material through a disperser to form the fiber bundles.

6. The method of claim 1, wherein the fiber bundles are between about 200 and about 5000 micrometers mean area-weighted convoluted width.

7. The method of claim 1, wherein the fiber bundles are between about 1000 and about 2000 micrometers mean area-weighted convoluted width.

8. The method of claim 1, wherein the thermal drying comprises flash drying.

9. The method of claim 1, wherein the dried fiber bundles are dry defiberized.

10. The method of claim 1, wherein the hydrophilic material comprises never-been-dried wood pulp.

11. The method of claim 1, wherein fibers of the hydrophilic material have a two-dimensional, flat fiber morphology and individual fibers provided by the defiberizing the dried fiber bundles have a three-dimensional twisted fiber morphology.

12. A method of producing twisted, curly fibers, comprising:

providing a slurry of a hydrophilic material;

forming the slurry of the hydrophilic material into a plurality of fiber bundles;

thermally drying the fiber bundles at a temperature between about 120 and about 400 degrees Celsius for a duration of between about 0.1 and about 60 seconds; and repulping the dried fiber bundles in water to defiberize the dried fiber bundles.

13. The method of claim 12, wherein the hydrophilic material is selected from the group consisting of microcrystalline cellulose, microfibrillated cellulose, wood pulp fiber, and combinations thereof.

14. The method of claim 12, further comprising dewatering the slurry to a consistency between about 10% and about 60%.

15. The method of claim 12, further comprising dewatering the slurry to a consistency between about 25% and about 40%.

16. The method of claim 12, comprising extruding the slurry of the hydrophilic material through a disperser to form the fiber bundles.

17. The method of claim 12, wherein the fiber bundles are between about 200 and about 5000 micrometers mean area-weighted convoluted width.

18. The method of claim 12, wherein the fiber bundles are between about 1000 and about 2000 micrometers mean area-weighted convoluted width.

19. The method of claim 12, wherein the thermal drying comprises flash drying.

20. The method of claim 12, wherein the hydrophilic material comprises never-been-dried wood pulp.

21. The method of claim 12, wherein fibers of the hydrophilic material have a two-dimensional, flat fiber morphology and individual fibers provided by the defiberizing the dried fiber bundles have a three-dimensional twisted fiber morphology.

* * * * *